US008127496B2

(12) United States Patent
Maruyama et al.

(10) Patent No.: US 8,127,496 B2
(45) Date of Patent: Mar. 6, 2012

(54) WIRE TYPE WINDOW REGULATOR

(75) Inventors: Katsuaki Maruyama, Toyota (JP); Takanori Natsume, Okazaki (JP); Kimihiro Kinoshita, Toyokawa (JP)

(73) Assignees: Toyota Jidosha Kabushiki Kaisha, Toyota-shi, Aichi-ken (JP); Shiroki Corporation, Kanagawa (JP)

( * ) Notice: Subject to any disclaimer, the term of this patent is extended or adjusted under 35 U.S.C. 154(b) by 645 days.

(21) Appl. No.: 12/301,252

(22) PCT Filed: May 25, 2007

(86) PCT No.: PCT/JP2007/061144

§ 371 (c)(1),
(2), (4) Date: Nov. 18, 2008

(87) PCT Pub. No.: WO2007/142128

PCT Pub. Date: Dec. 13, 2007

(65) Prior Publication Data

US 2009/0188167 A1 Jul. 30, 2009

(30) Foreign Application Priority Data

May 26, 2006 (JP) ..... 2006-147342

(51) Int. Cl.
*E05F 11/48* (2006.01)

(52) U.S. Cl. ..... 49/352; 49/348; 49/349; 49/502

(58) Field of Classification Search ..... 49/348, 49/349, 352, 502
See application file for complete search history.

(56) References Cited

U.S. PATENT DOCUMENTS 3,910,588 A * 10/1975 Austin ..... 411/542
4,199,899 A * 4/1980 Muhling et al. ..... 49/352
5,040,430 A 8/1991 Adam et al.
5,074,077 A * 12/1991 Toyoshima et al. ..... 49/352
(Continued)

FOREIGN PATENT DOCUMENTS

DE 42 01 036 C1 11/1992
(Continued)

OTHER PUBLICATIONS

Notice of Reasons for Rejection for JP Appl. No. 2006-147342 dated Sep. 14, 2010.

*Primary Examiner* — Katherine W Mitchell
*Assistant Examiner* — Justin Rephann
(74) *Attorney, Agent, or Firm* — Finnegan, Henderson, Farabow, Garrett & Dunner, LLP

(57) ABSTRACT

In a window regulator 10, when a pin bolt 42 provisionally attached to a pulley 22 and a pulley support 54 is fastened to a door panel 14 by a nut 52, the pulley 22 and the pulley support 54 are supported on the pin bolt 42 and attached to a predetermined position on the door panel 14. Here, in the above-described provisionally attached state, the pin bolt 42 is held in the pulley 22 by pin member holding claws 74 of the pulley 22, and the pulley 22 is held in the pulley support 54 by pulley holding claws 68 of the pulley support 54. Consequently, when the pin bolt 42 is to be fastened to a body panel, the pulley 22, the pulley support 54, and the pin bolt 42 can be handled as a single part. Thus, the work of attaching a pulley and a pulley support to a body panel of a vehicle can be facilitated.

11 Claims, 5 Drawing Sheets

U.S. PATENT DOCUMENTS

| | | | | |
|---|---|---|---|---|
| 5,082,412 | A * | 1/1992 | Thomas | 411/533 |
| 5,333,411 | A * | 8/1994 | Tschirschwitz et al. | 49/352 |
| 5,564,231 | A * | 10/1996 | Tajima et al. | 49/352 |
| 5,657,580 | A * | 8/1997 | Kobrehel | 49/352 |
| 6,227,993 | B1 * | 5/2001 | Medebach | 474/144 |
| 6,584,731 | B2 * | 7/2003 | Arquevaux et al. | 49/352 |
| 6,607,339 | B1 | 8/2003 | Mangapora | |
| 6,640,497 | B2 * | 11/2003 | Sakaguchi et al. | 49/352 |
| 2002/0020116 | A1 * | 2/2002 | Arquevaux et al. | 49/349 |
| 2006/0037247 | A1 * | 2/2006 | Heyer et al. | 49/352 |
| 2007/0119017 | A1 * | 5/2007 | Trotter et al. | 16/2.1 |

FOREIGN PATENT DOCUMENTS

| | | | |
|---|---|---|---|
| EP | 0 653 538 | A2 | 5/1995 |
| EP | 1 243 733 | A1 | 9/2002 |
| FR | 2 851 001 | | 8/2004 |
| JP | U 3-41318 | | 4/1991 |
| JP | U 6-20808 | | 3/1994 |
| JP | 2002-97838 | | 4/2002 |
| JP | 2002-138750 | | 5/2002 |
| JP | 2003-254398 | | 9/2003 |
| JP | 2006-76457 | | 3/2006 |

* cited by examiner

WIRE TYPE WINDOW REGULATOR

CROSS-REFERENCE TO RELATED APPLICATIONS

This application is a national phase application of International Application No. PCT/JP2007/061144, filed May 25, 2007, and claims priority under 35 USC 119 from Japanese Patent Application No. 2006-147342, filed May 26, 2006, the contents of both of which are incorporated by reference herein.

BACKGROUND OF THE INVENTION

1. Field of the Invention

The present invention relates to a wire type window regulator that causes a window glass in a vehicle such as an automobile to move.

2. Description of the Related Art

Conventionally, a wire type window regulator of a configuration that dispenses with a guide rail that guides the movement (up and down) of a window glass has been devised (e.g., see Japanese Patent Application Laid-open No. 2002-138750). In this wire type window regulator, pulleys wound with wires for driving the window glass are attached to a door panel of a vehicle via brackets, and outer casings that cover the wires are engaged to engagement portions disposed in the brackets.

However, in the wire type window regulator of this configuration, there have been difficulties that the weight of the device is heavy due to the aforementioned brackets and the manufacturing cost becomes higher. For this reason, it is preferable to attach the pulleys and holding members (pulley supports) of the outer casings directly to the door panel of the vehicle, but in this case, the work of attaching the pulleys and the pulley supports to the door panel becomes cumbersome.

SUMMARY OF THE INVENTION

In view of these circumstances, the present invention provides a wire type window regulator that can facilitate the work of attaching pulleys and pulley supports to a body panel of a vehicle.

A wire type window regulator of a first aspect of the invention comprises a wire that is coupled to a window glass of a vehicle, is driven by a drive source to cause the window glass to move, and is partially covered by a cover member; a pulley support to which the cover member is attached; a pulley around which the wire is wound; a pin member that is attached to a body panel of the vehicle in a state where the pin member is provisionally attached to the pulley and the pulley support, and which supports the pulley and the pulley support; and a separation prevention portion that prevents separation of the pulley, the pulley support, and the pin member in the provisionally attached state.

In this aspect, the body panel is a panel that configures the body of a vehicle and also includes a door panel that configures a door of a vehicle.

According to the above aspect, when the pin member provisionally attached to the pulley and the pulley support is attached to the body panel of the vehicle, the pulley and the pulley support are supported on the pin member. Here, in the wire type window regulator, in this provisionally attached state, the separation prevention portion prevents separation of the pulley, the pulley support, and the pin member. Consequently, the pulley, the pulley support, and the pin member can be handled as a single part when the pin member is to be attached to the body panel, so the work of attaching the pulley and the pulley support to the body panel can be facilitated.

In this aspect, the separation prevention portion may include a first separation prevention portion that causes the pin member to be held in the pulley and a second separation prevention portion that causes the pulley to be held in the pulley support.

According to this aspect, the pin member is held in the pulley by the first separation prevention portion and the pulley is held in the pulley support by the second separation prevention portion. Thus, separation of the pulley, the pulley support, and the pin member in the provisionally attached state is prevented.

In this aspect, the first separation prevention portion may comprise a pin member holding claw that is disposed in the pulley and engages with the pin member.

According to this aspect, the pin member is held in the pulley as a result of the pin member holding claw disposed in the pulley engaging with the pin member.

In this aspect, the second separation prevention portion may comprise a pulley holding claw that is disposed in the pulley support and engages with the pulley.

According to this aspect, the pulley is held in the pulley support as a result of the pulley holding claw disposed in the pulley support engaging with the pulley.

In this aspect, the pulley support may include a pair of the pulley holding claws, a first slanted surface that guides the engagement between the pulley and the pulley holding claws may be formed on one of the pulley holding claws, and a second slanted surface that slides against the pulley and causes the other of the pulley holding claws to bend as a result of the pulley being pushed toward the pulley support may be formed on the other of the pulley holding claws.

According to this aspect, when the pulley is to be provisionally attached to the pulley support, the pulley can be caused to engage with one of the pulley holding claws by the guidance of the first slanted surface formed on one of the pulley holding claws. Additionally, when the pulley is pushed toward the pulley support, the second slanted surface of the other of the pulley holding claws slides against the pulley and the other of the pulley holding claws bends, so that the pulley can be caused to engage with the other of the pulley holding claws.

A wire type window regulator of a second aspect of the invention comprises: a wire that is coupled to a window glass of a vehicle, is driven by a drive source to cause the window glass to move, and is partially covered by a cover member; a pulley support to which the cover member is attached; a pulley around which the wire is wound; a pin member that is attached to a body panel of the vehicle as a result of the pin member penetrating the pulley, the pulley support, and the body panel and a nut being screwed onto a distal end side of the pin member, whereby the pin member supports the pulley and the pulley support; and a corotation regulating portion that regulates corotation of the pin member with the nut when the nut is screwed onto the pin member.

In this aspect, the body panel is a panel that configures the body of a vehicle and also includes a door panel that configures a door of a vehicle.

According to this aspect, the nut is screwed onto the distal end side of the pin member penetrating the pulley, the pulley support, and the body panel of the vehicle, whereby the pin member is attached to the body panel, and the pulley and the pulley support are supported on the pin member. Here, in this wire type window regulator, when the nut is screwed onto the pin member, the corotation regulating portion regulates corotation of the pin member. Thus, the work of attaching the pulley and the pulley support to the body panel can be facilitated.

In this aspect, the corotation regulating portion may include a first regulating portion that regulates relative rotation of the pin member with respect to the pulley support and a second regulating portion that regulates relative rotation of the pulley support with respect to the body panel.

According to this aspect, relative rotation of the pin member with respect to the pulley support is regulated by the first regulating portion, and relative rotation of the pulley support with respect to the body panel is regulated by the second regulating portion. Thus, corotation of the pin member when the nut is screwed onto the pin member is regulated.

In this aspect, the first regulating portion may include a stopping portion having a predetermined shape and being disposed on the pin member, and a fitting hole that is provided in the pulley support, and into which the stopping portion fits.

According to this aspect, the stopping portion disposed on the pin member fits together with the fitting hole provided in the pulley support, whereby relative rotation of the pin member with respect to the pulley support is regulated.

In this aspect, the second regulating portion may include a projection disposed on the pulley support and an insertion hole that is provided in the body panel and into which the projection is inserted.

According to this aspect, the projection disposed on the pulley support is inserted into the insertion hole provided in the body panel, whereby relative rotation of the pulley support with respect to the body panel is regulated.

In this aspect, the predetermined shape is the shape of a surface of the stopping portion that is orthogonal to an axial line of the pin member. The shape may be a hexagonal shape.

A wire type window regulator of a third aspect of the invention comprises: a wire that is coupled to a window glass of a vehicle, is driven by a drive source to cause the window glass to move, and is partially covered by a cover member; a pulley support to which the cover member is attached; a pulley around which the wire is wound; a pin member that penetrates a body panel of the vehicle in a state where the pin member is provisionally attached to the pulley and the pulley support, and is attached to the body panel as a result of a nut being screwed onto a distal end side of the pin member, whereby the pin member supports the pulley and the pulley support; and a limiting portion comprising a separation prevention portion and a corotation regulating portion, wherein the separation prevention portion prevents separation of the pulley, the pulley support, and the pin member and the corotation regulating portion regulates corotation of the pin member with the nut when the nut is screwed onto the pin member.

In this aspect, the body panel is a panel that configures the body of a vehicle and also includes a door panel that configures a door of a vehicle.

According to this aspect, the pin member penetrates the body panel of the vehicle in a state where the pin member is provisionally attached to the pulley and the pulley support, and the nut is screwed onto the distal end side of the pin member, whereby the pin member is attached to the body panel, and the pulley and the pulley support are supported on the pin member. Here, in this wire type window regulator, the limiting portion includes a separation prevention portion that prevents separation of the pulley, the pulley support, and the pin member, and a corotation regulating portion that regulates corotation of the pin member with the nut when the nut is screwed onto the pin member. Thus, the work of attaching the pulley and the pulley support to the body panel can be facilitated.

In this aspect, the limiting portion may include a first limiting portion that regulates separation and relative rotation of the pin member with respect to the pulley support and a second regulating portion that regulates relative rotation of the pulley support with respect to the body panel.

According to this aspect, separation and relative rotation of the pin member with respect to the pulley support is regulated by the first limiting portion, and relative rotation of the pulley support with respect to the body panel is regulated by the second regulating portion. Thus, separation of the pulley, the pulley support, and the pin member in the provisionally attached state is prevented and corotation of the pin member when the nut is screwed onto the pin member is regulated.

In this aspect, the first limiting portion may include a stopping portion having a predetermined shape and being disposed on the pin member and a fitting hole that is provided in the pulley support and with which the stopping portion fits, and wherein the stopping portion and the fitting hole fit together so as to substantially not relatively move.

According to this aspect, the pin member is held in the pulley support by the first limiting portion. Thus, separation of the pulley, the pulley support, and the pin member in the provisionally attached state is prevented.

In this aspect, the second regulating portion may include a projection disposed on the pulley support and an insertion hole that is provided in the body panel and into which the projection is inserted.

According to this aspect, the projection disposed on the pulley support is inserted into the insertion hole provided in the body panel, whereby relative rotation of the pulley support with respect to the body panel is regulated.

As described above, in the wire type window regulator pertaining to the present invention, the work of attaching a pulley and a pulley support to a body panel of a vehicle can be facilitated.

BRIEF DESCRIPTION OF THE DRAWINGS

An embodiment of the present invention will be described in detail based on the following figures, wherein.

DETAILED DESCRIPTION OF THE INVENTION

Figure 1:
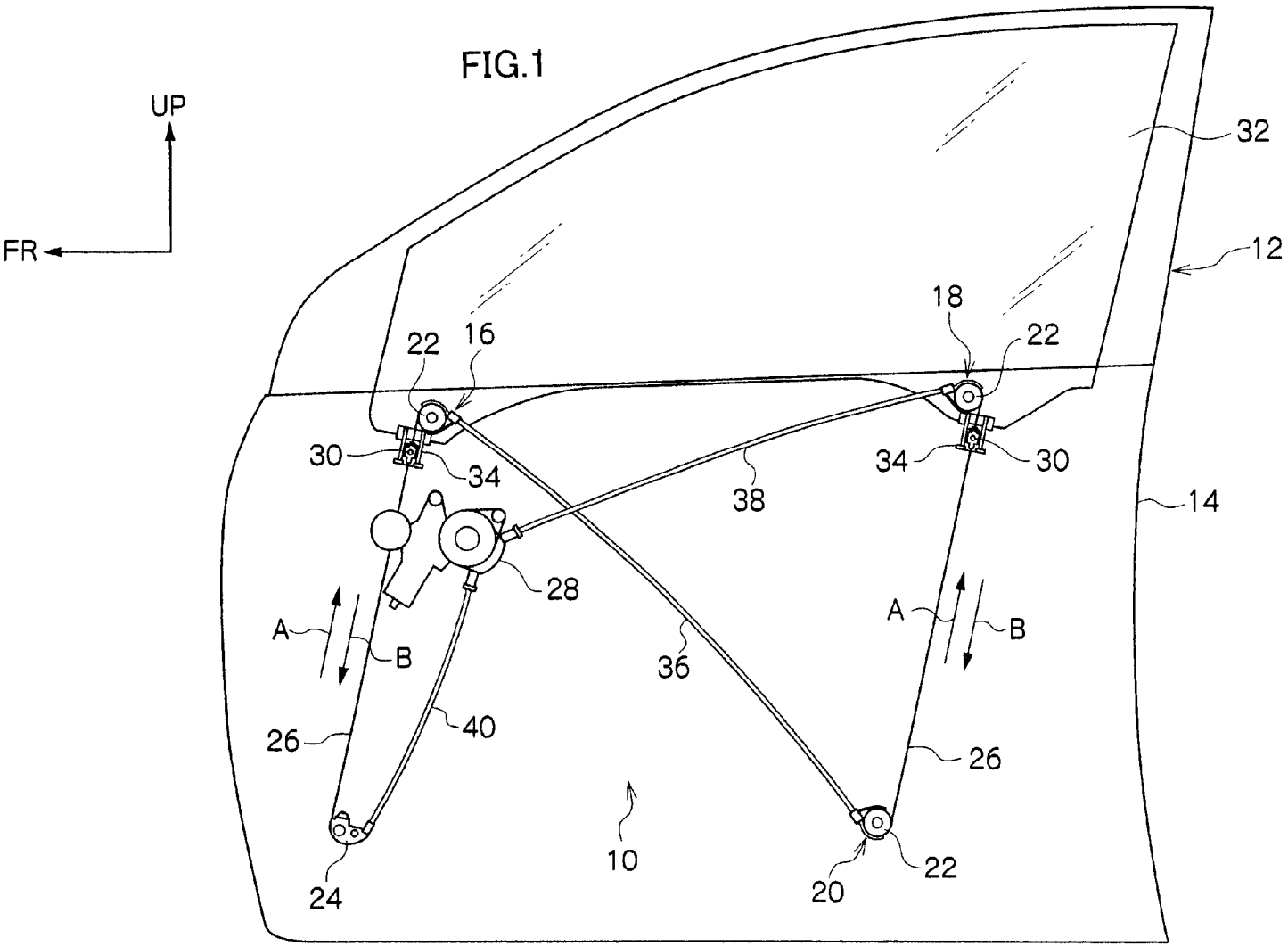
FIG. 1 is a front view, seen from a vehicle width direction inner side, of a vehicle door to which a wire type window regulator pertaining to the embodiment of the invention is attached.

In FIG. 1, there is shown the configuration of a vehicle door 12 to which a wire type window regulator 10 (simply called "the window regulator 10" herein below) pertaining to an embodiment of the present invention is attached. The vehicle door 12 is shown in front view as seen from a vehicle inner side in the vehicle width direction. It will be noted that, in FIG. 1, arrow UP represents a vehicle up direction and arrow FR represents a vehicle front direction.

The window regulator 10 pertaining to the present embodiment is disposed inside a door panel 14 of the vehicle door 12 and includes plural (three in the present embodiment) pulley units 16, 18, and 20. These pulley units 16, 18, and 20 are disposed, in vehicle longitudinal direction, at both sides of the upper portion of the door panel 14 and at the rear side of the lower portion of the door panel 14, and each includes a pulley 22 that is rotatably attached to the door panel 14. The pulley units 16, 18, and 20 will be described in greater detail later.

The window regulator 10 also includes a lower shoe 24 disposed at the vehicle front side of the lower portion of the door panel 14. The lower shoe 24 is formed in a substantially semicircular block shape with a resin material or the like and is fastened, so as to not be rotatable, to the door panel 14 by a bolt and a nut.

The window regulator 10 also includes an endless wire 26 that is wound in a substantial "figure 8" manner between the lower shoe 24 and each of the pulleys 22 of the three pulley units 16, 18, and 20. The wire 26 is introduced into a wire take-up device 28 between the pulley unit 18 and the lower shoe 24. The wire take-up device 28 is fastened to the door panel 14 by plural bolts and nuts, and an unillustrated spool that is rotated in a forward direction and a reverse direction by the driving force of a motor is disposed inside the wire take-up device 28. The wire 26 introduced into the wire take-up device 28 is wound around the spool, so that when the wire take-up device 28 is actuated, the wire 26 is driven in the direction of arrow A or the direction of arrow B in FIG. 1.

A carrier piece 30 formed in a substantial block shape is attached between the pulley unit 16 and the lower shoe 24 and between the pulley unit 18 and the pulley unit 20. These carrier pieces 30 are engaged to glass holders 34 attached to the lower end portion of a window glass 32 of the vehicle door 12. The window glass 32 is supported, so as to be movable up and down, by a pair of unillustrated front and back glass guides disposed inside the door panel 14. When the wire 26 is driven in the direction of arrow A in FIG. 1, the window glass 32 moves upward with respect to the vehicle door 12, and when the wire 26 is driven in the direction of arrow B in FIG. 1, the window glass 32 moves downward with respect to the vehicle door 12.

It will be noted that the areas of the wire between the pulley unit 16 and the pulley unit 20, between the pulley unit 18 and the wire take-up device 28, and between the wire take-up device 28 and the lower shoe 24 are respectively covered by outer casings 36, 38, and 40 serving as cover members.

Figure 2:
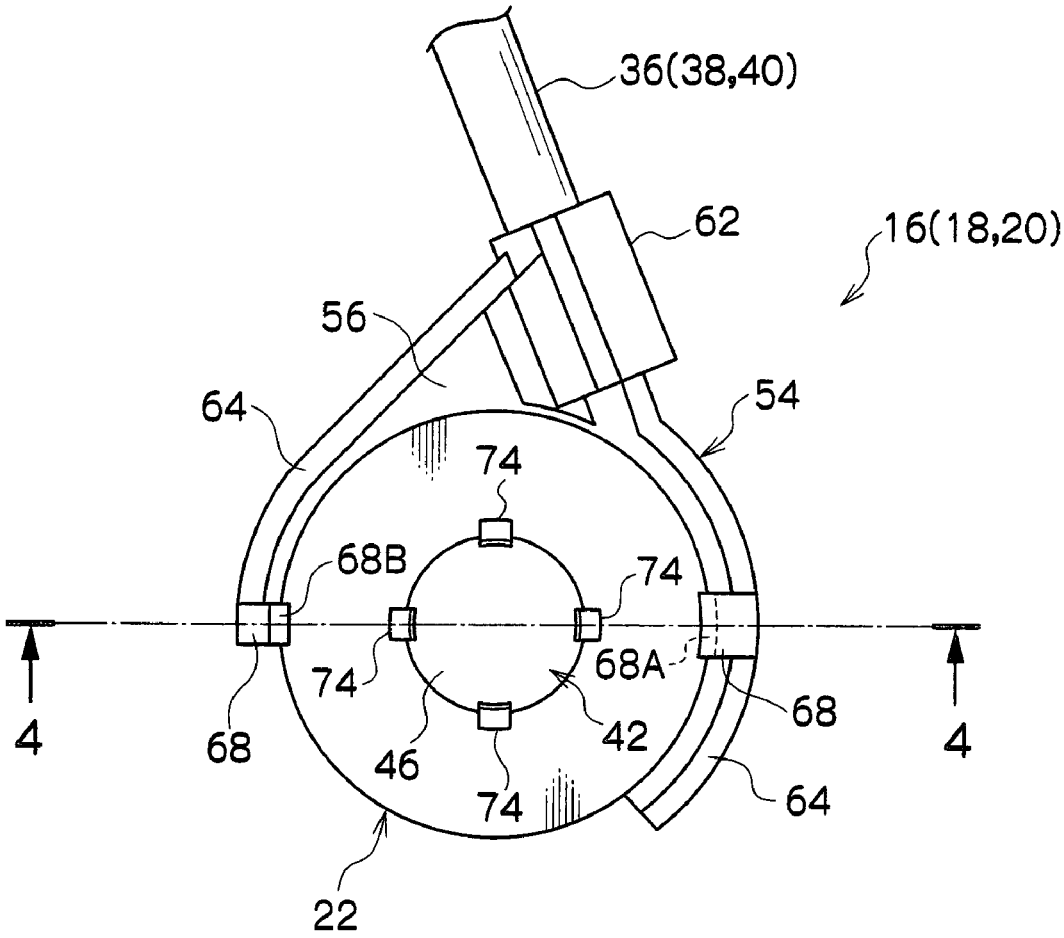
FIG. 2 is a plan view showing the configuration of a pulley unit that is a member included in the wire type window regulator pertaining to the embodiment of the invention.
Figure 3:
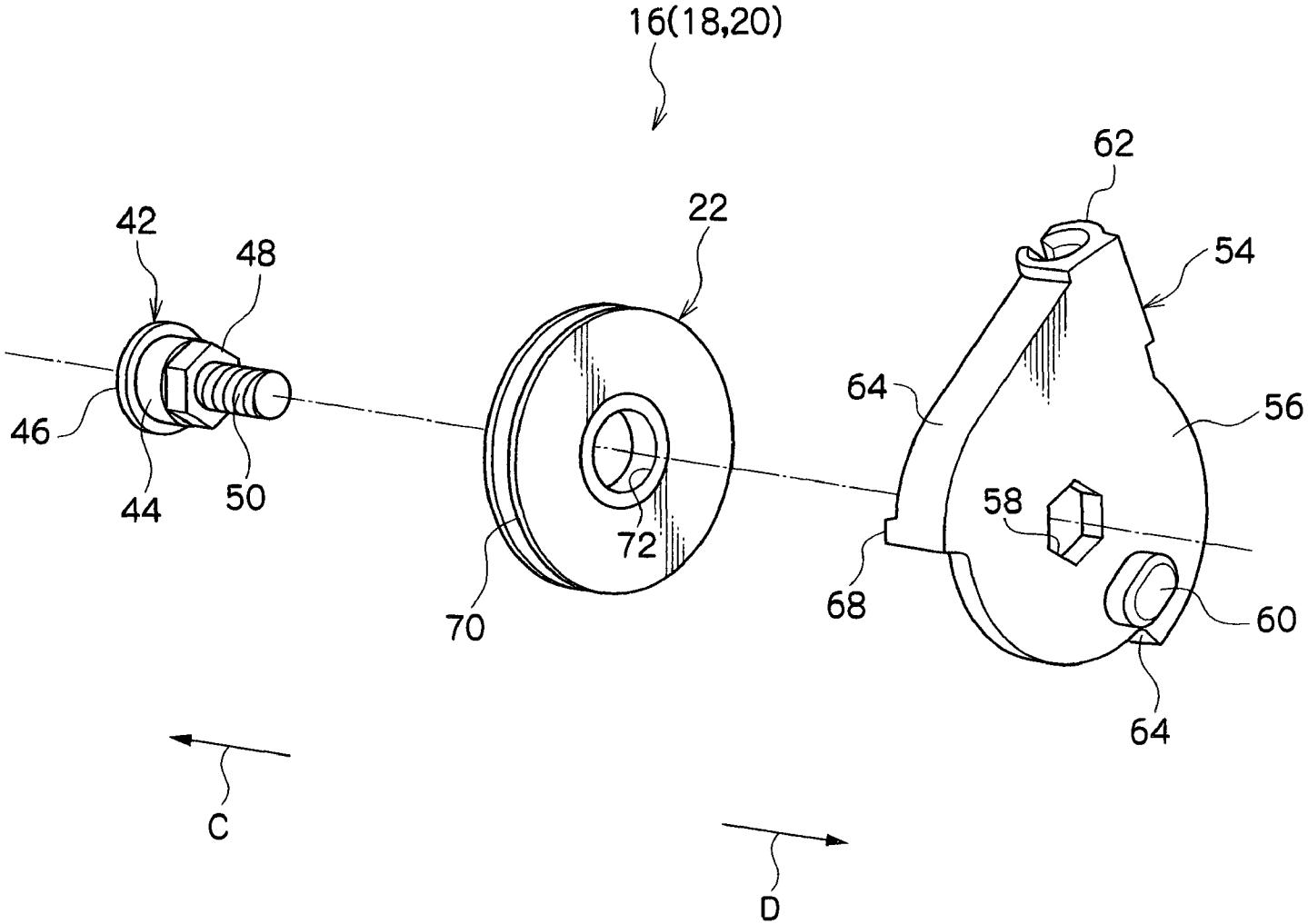
FIG. 3 is an exploded perspective view showing the configuration of the pulley unit that is a member included in the wire type window regulator pertaining to the embodiment of the invention.

Next, the pulley units 16, 18, and 20 will be described in greater detail. In FIG. 2, the configuration of the pulley units 16, 18, and 20 is shown in plan view. In FIG. 3, the configuration of the pulley units 16, 18, and 20 is shown in exploded perspective view. Further, in FIG. 4, a cross-sectional view along line 4-4 of FIG. 2 is shown.

As shown in these drawings, each of the pulley units 16, 18, and 20 includes a pin bolt 42 serving as a pin member. The pin bolt 42 is formed by a metal material or the like and includes a pulley support portion 44 formed in a circular column shape. A retaining portion 46 that projects in the radial direction of the pulley support portion 44 is formed at one side in the axial direction (arrow C direction side) of the pulley support portion 44, and a predetermined shape (hexagonal in the present embodiment) stopping portion 48 is formed on the other side in the axial direction (arrow D direction side) of the pulley support portion 44. Note that arrow C direction side is indicated as "the one side in the axial direction" and arrow D direction side is indicated as "the other side in the axial direction" in some parts hereinafter. Moreover, an outer screw portion 50 that is formed in a circular column shape and is provided threads at outer peripheral portion thereof is disposed at the other side in the axial direction of the stopping portion 48.

The pin bolt 42 is attached to the door panel 14 by inserting the outer screw portion 50 (distal end side) into a through hole 14A formed in the door panel 14 (inner panel) and screwing the outer screw portion 50 into a nut 52 after the outer screw portion 50 penetrating the through hole 14A.

Each of the pulley units 16, 18, and 20 also includes a pulley support 54. The pulley support 54 is formed by a resin material or the like and includes a body portion 56 formed in a substantially discoid shape. A hexagonal fitting hole 58 is formed in the center portion of the body portion 56 and penetrates the body portion 56 in the axial direction of the pulley support 54. A projection 60 is disposed at the outer peripheral side of the body portion 56 at the other side in the axial direction. Further, an outer casing attachment portion 62 to which the end portion of the outer casing 36 (38, 40) is engaged, and side wall portion 64 which projects toward the one side in the axial direction, are formed at part of the outer periphery of the body portion 56. A pair of pulley holding claws 68 that project inward in the radial direction of the body portion 56 are formed at the one side in the axial direction of the side wall portion 64. These pulley holding claws 68 are disposed at the side wall portion 64 in point-symmetrical positions via the fitting hole 58.

The pulley support 54 is supported by the pin bolt 42 as a result of the stopping portion 48 of the pin bolt 42 being fitted together with, so as to not be relatively rotatable, the fitting hole 58. A stepped portion formed at a portion where the stopping portion 48 and the pulley support portion 44 connect each other engages with the hole edge portion of the fitting hole 58, whereby movement of the pulley support 54 toward the one side in the axial direction with respect to the pin bolt 42 is regulated, and the other side in the axial direction of the body portion 56 engages with the door panel 14, whereby movement of the pulley support 54 toward the other side in the axial direction with respect to the pin bolt 42 is regulated. Further, the projection 60 disposed on the body portion 56 is inserted into an unillustrated insertion hole formed in the door panel 14, whereby rotation of the pulley support 54 around the pin bolt 42 with respect to the door panel 14 is regulated.

Figure 4:
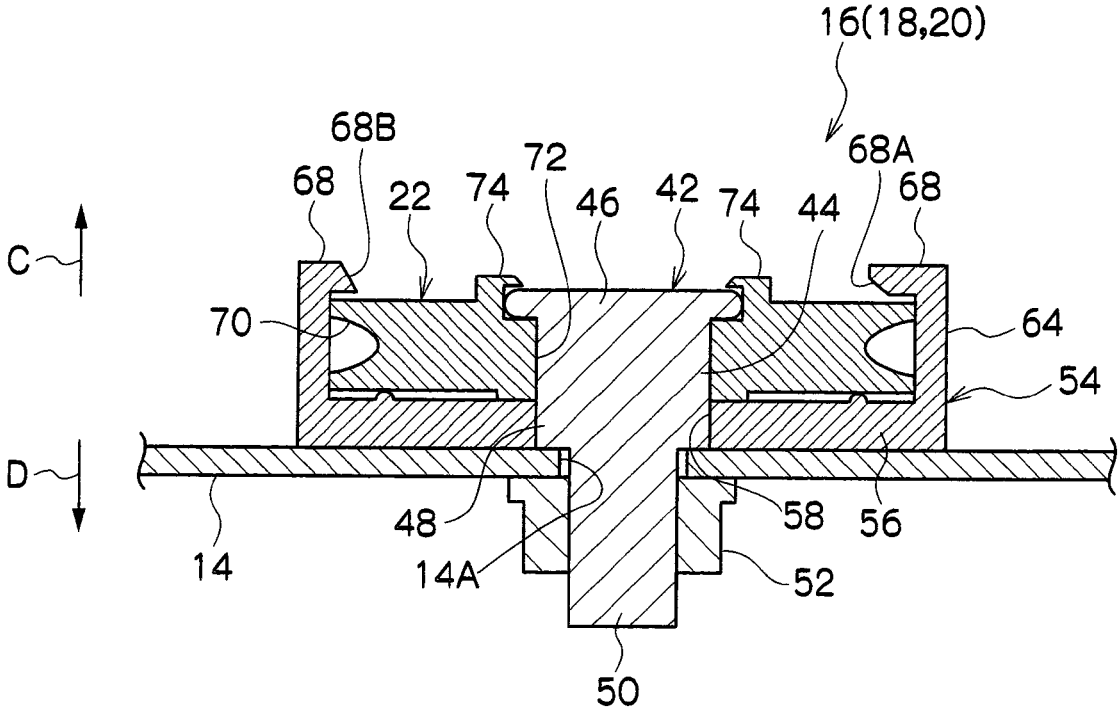
FIG. 4 is a cross-sectional view along line 4-4 of FIG. 2.
Figure 5:
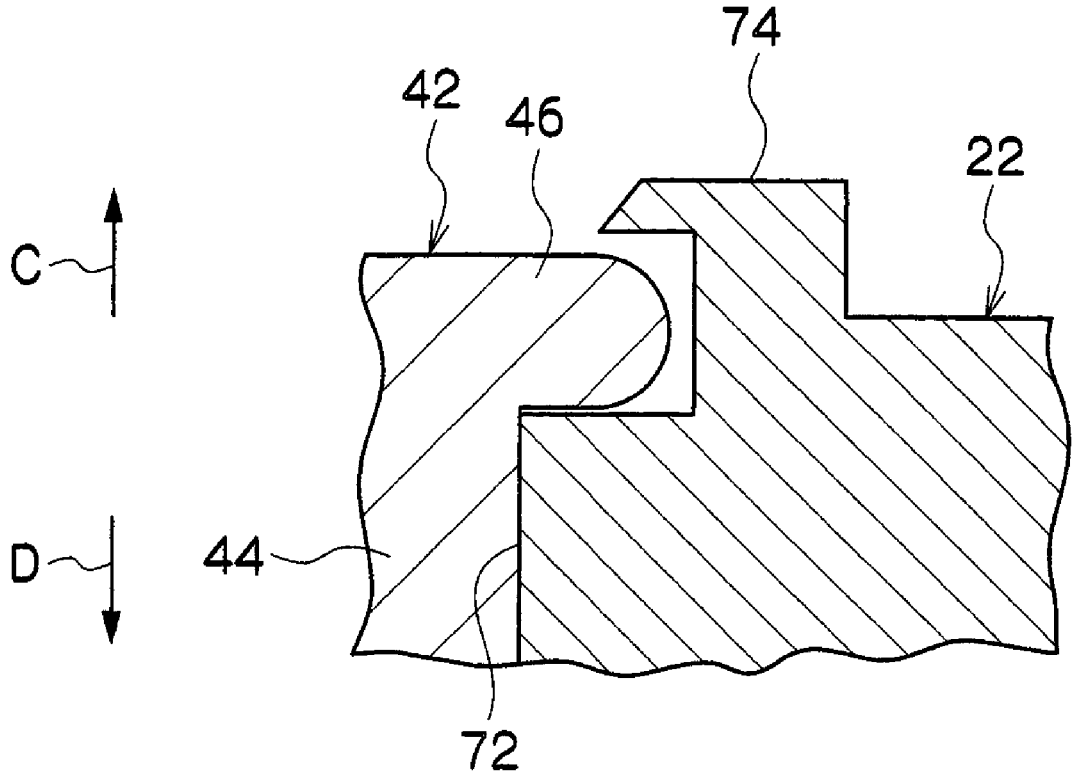
FIG. 5 is a cross-sectional view showing the partial configuration of a pin bolt and a pulley pertaining to the embodiment of the invention.

The pulley units 16, 18, and 20 are disposed with the pulleys 22 as mentioned previously. Each of the pulleys 22 is formed in a discoid shape with a resin material or the like, and a wire wound groove 70 in which the wire 26 is wound around is formed on the outer peripheral portion of each of the pulleys 22. Further, a circular through hole 72 is formed in the axial center portion of each of the pulleys 22. The through hole 72 is formed in step shape such that the one side in the axial direction of the through hole 72 has a larger diameter than the other side in the axial direction side thereof. Moreover, as shown in FIG. 2, FIG. 4, and FIG. 5, at an end portion at the one side in the axial direction of the pulleys 22, plural (four in the present embodiment) pin member holding claws 74 are disposed at the hole edge portion of the through hole 72 of each of the pulleys 22. These pin member holding claws 74 are formed in substantial L shapes such that their distal end sides project inward in the radial direction of the pulley 22, and the pin member holding claws 74 are disposed at equidistant intervals along the circumferential direction of the pulley 22.

The pulley 22 is rotatably supported on the pin bolt 42 as a result of the pulley support portion 44 rotatably fitting together with the through hole 72. The retaining portion 46 of the pin bolt 42 engages with the stepped portion of the through hole 72, whereby relative movement of the pulley 22 toward the one side in the axial direction with respect to the pin bolt 42 is regulated, and an end portion at the other side in the axial direction of the pulley 22 engages with the body portion 56 of the pulley support 54, whereby movement of the pulley 22 toward the other side in the axial direction with respect to the pin bolt 42 is regulated. Further, part of the outer periphery of the pulley 22 is covered by the side wall portions 64 of the pulley support 54.

As shown in FIG. 4, each of the pulley units 16, 18, and 20 having the above configuration is attached to the door panel 14 in a state where the pin bolt 42 is attached to the pulley 22, and the pulley 22 and the pin bolt 42 are attached to the pulley support 54 (provisionally attached state). In this provisionally attached state, the pin member holding claws 74 of the pulley 22 engage with the retaining portion 46 of the pin bolt 42, whereby the pin bolt 42 is held in the pulley 22 (such that separation of the pin bolt 42 from the pulley 22 is prevented). Further, in this provisionally attached state, the pulley holding claws 68 of the pulley support 54 engage with the outer peripheral portion of the pulley 22, whereby the pulley 22 is held in the pulley support 54 (such that separation of the pulley 22 from the pulley support 54 is prevented).

Moreover, a first slanted surface 68A that facilitates insertion of the pulley 22 is formed at a side that engages with the pulley 22 (in FIG. 4, the lower side) of the distal end portion of one of the pulley holding claws 68 (in FIG. 4, the one on the right side). Further, a second slanted surface 68B that pushes against the pulley 22 and causes the other pulley holding claw 68 to bend is formed at an opposite side to a side that engages with the pulley 22 (in FIG. 4, the upper side) of the distal end portion of the other of the pulley holding claws 68 (in FIG. 4, the one on the left side). For this reason, when the pulley 22 is to be provisionally attached to the pulley support 54, the pulley 22 is caused to go under the lower side of the one of the pulley holding claws 68 by the guidance of the first slanted surface 68A formed on the one of the pulley holding claws 68, and when the pulley 22 is pushed toward the body portion 56 of the pulley support 54, the pulley 22 slides against the second slanted surface 68B of the other of the pulley holding claws 68 and the other pulley holding claw 68 bends outward in the radial direction of the body portion 56 due to the principle of leverage. Thus, the pulley 22 can be inserted toward the body portion 56 of the pulley support 54. Then, when the end portion at the other side in the axial direction (in FIG. 4, the end portion on the lower side) of the pulley 22 engages with the body portion 56 of the pulley support 54, the pulley holding claws 68 elastically return so that the distal end portions of the pulley holding claws 68 engage with the outer peripheral portion of the end side at the one side in the axial direction (in FIG. 4, the upper side) of the pulley 22.

When the pin bolt 42 is to be provisionally attached to the pulley 22, an end portion at the other side in the axial direction of the retaining portion 46 engages with slanted surfaces formed on the distal ends of the pin member holding claws 74, whereby the distal end sides of the pin member holding claws 74 first bend outward in the radial direction of the pulley 22 and then elastically return and engage with an end portion at the one side in the axial direction of the retaining portion 46.

Next, the action of the present embodiment will be described.

In the window regulator 10 of the above-described configuration, when the pin bolt 42 provisionally attached to the pulley 22 and the pulley support 54 is fastened to the door panel 14 by the nut 52, the pulley 22 and the pulley support 54 are supported on the pin bolt 42 and attached to a predetermined position on the door panel 14. Here, in the above-described provisionally attached state, the pin bolt 42 is held in the pulley 22 by the pin member holding claws 74 of the pulley 22, and the pulley 22 is held in the pulley support 54 by the pulley holding claws 68 of the pulley support 54. Consequently, when the pin bolt 42 is to be fastened to the body panel, the pulley 22, the pulley support 54, and the pin bolt 42 can be handled as a single part, so that the work of attaching the pulley 22 and the pulley support 54 to the door panel 14 can be facilitated.

Moreover, when the nut 52 is to be screwed onto the pin bolt 42, the stopping portion 48 of the pin bolt 42 fits together with the fitting hole 58 in the pulley support 54, whereby relative rotation of the pin bolt 42 with respect to the pulley support 54 is regulated, and the projection 60 disposed on the pulley support 54 is inserted into the unillustrated insertion hole formed in the door panel 14, whereby relative rotation of the pulley support 54 around the pin bolt 42 with respect to the door panel 14 is regulated. For this reason, corotation of the pin bolt 42 with the nut 52 can be regulated, whereby the work of attaching the pulley 22 and the pulley support 54 to the door panel 14 can be facilitated.

Moreover, attachment of the window regulator 10 to the door panel 14 is easy because the dimensional relationships (relationships between attachment positions) between the wire take-up device 28 and the pulley unit 18, between the pulley unit 16 and the pulley unit 20, and between the wire take-up device 28 and the lower shoe 24 are maintained by the three outer casings 36, 38, and 40.

That is, when the window regulator 10 is to be attached to the door panel 14, first, the wire take-up device 28 is attached to the door panel 14, and next the pulley unit 16 is attached to the door panel 14. In this state, the dimensional relationship between the wire take-up device 28 and the pulley unit 18 is maintained by the outer casing 38, the dimensional relationship between the pulley unit 16 and the pulley unit 20 is maintained by the outer casing 36, and the dimensional relationship between the wire take-up device 28 and the lower shoe 24 is maintained by the outer casing 40. Consequently, the pulley unit 18 and the lower shoe 24 can be easily attached to predetermined positions on the door panel 14.

Moreover, in the window regulator 10, when the pulley 22 is to be provisionally attached to the pulley support 54, the pulley 22 can be slipped under the lower side of one of the pulley holding claws 68 by the guidance of the first slanted surface 68A formed on one of the pulley holding claws 68. Further, the other pulley holding claw 68 can be caused to bend according to the principle of leverage generated by the sliding of the pulley 22 against the second slanted surface 68B of the other of the pulley holding claws 68, so that the pulley 22 can be provisionally attached to the pulley support 54 by a small attachment load.

In the above-described embodiment, each of the pulleys 22 has four pin member holding claws 74 and each of the pulley supports 54 has two pulley holding claws 68, but the present invention is not limited to this. It is preferable to appropriately set and change the number of the pin member holding claws 74 and the number of the pulley holding claws 68.

Further, in the above-described embodiment, separation of the pulley 22, the pulley support 54, and the pin bolt 42 is prevented by the pin member holding claws 74 disposed in the pulley 22 and by the pulley holding claws 68 disposed in the pulley support 54, but the present invention is not limited to this. For example, separation of the pulley 22, the pulley support 54, and the pin bolt 42 may also be prevented as a result of the stopping portion 48 of the pin bolt 42 being strongly fitted together with the fitting hole 58 in the pulley support 54.

Moreover, in the above-described embodiment, the stopping portion 48 of the pin bolt 42 and the fitting hole 58 in the pulley support 54 were both formed in hexagonal shapes, but the present invention is not limited to this. The stopping portion 48 and the fitting hole 58 may be of any shape that can regulate relative rotation between the pin bolt 42 and the pulley support 54, and may be any shapes such as square or triangular.

Further, in the above-described embodiment, corotation of the pin bolt 42 when the nut 52 is screwed onto the pin bolt 42 is regulated as a result of the stopping portion 48 of the pin bolt 42 being fitted together with the fitting hole 58 in the pulley support 54 and the projection 60 on the pulley support 54 being inserted into the unillustrated insertion hole in the door panel 14, but the present invention is not limited to this. For example, corotation of the pin bolt 42 when the nut 52 is screwed onto the pin bolt 42 may also be regulated as a result of a projection formed on the pin bolt 42 being inserted into an insertion hole formed in the door panel 14.

Moreover, in the above-described embodiment, the window regulator 10 is attached to the door panel 14 of the vehicle door 12, but the present invention is not limited to this. The window regulator 10 may also be attached to a body panel of the vehicle other than the door panel 14.

The invention claimed is:

1. A wire type window regulator comprising:

a wire coupled to a window glass of a vehicle, wherein the wire is driven by a drive source to cause the window glass to move, and is partially covered by a cover member;

a pulley support to which the cover member is attached;

a pulley around which the wire is wound;

a pin member directly attached to a body panel of the vehicle in a state where the pin member is previously attached to the pulley and the pulley support, and supporting the pulley and the pulley support; and a separation prevention portion that prevents separation of the pulley, the pulley support, and the pin member in the previously attached state, wherein the separation prevention portion comprises a first separation prevention portion disposed on the pulley that causes the pin member to be held in the pulley, and a second separation prevention portion that causes the pulley to be held in the pulley support.

2. The wire type window regulator of claim 1, wherein the first separation prevention portion comprises a pin member holding claw that engages with the pin member.

3. The wire type window regulator of claim 1, wherein the second separation prevention portion comprises a pulley holding claw that is disposed in the pulley support and engages with the pulley.

4. The wire type window regulator of claim 3, wherein the pulley support includes a pair of the pulley holding claws, a first slanted surface that guides the engagement between the pulley and the pulley holding claws is formed on one of the pulley holding claws, and a second slanted surface that slides against the pulley and causes the other of the pulley holding claws to bend as a result of the pulley being pushed toward the pulley support is formed on the other of the pulley holding claws.

5. A wire type window regulator comprising:

a wire coupled to a window glass of a vehicle, wherein the wire is driven by a drive source to cause the window glass to move, and is partially covered by a cover member;

a pulley support to which the cover member is attached;

a pulley around which the wire is wound;

a pin member penetrating the pulley, the pulley support, and the body panel, and being secured to the body panel via a nut screwed onto a distal end side of the pin member, whereby the pin member supports the pulley and the pulley support; and a corotation regulating portion that prevents rotation of the pin member with respect to the body panel so as to regulate corotation of the pin member with the nut when the nut is screwed onto the pin member, the corotation regulating portion comprising a projection disposed on the pulley support, the projection being configured to be inserted into and fit non-rotatably in a hole provided in the body panel and to prevent relative rotation of the pulley support with respect to the body panel.

6. The wire type window regulator of claim 5, wherein the corotation regulating portion further comprises a first regulating portion that regulates relative rotation of the pin member with respect to the pulley support.

7. The wire type window regulator of claim 6, wherein the first regulating portion includes a stopping portion having a predetermined shape and being disposed on the pin member, and a fitting hole that is provided in the pulley support and the stopping portion fits with the fitting hole.

8. The wire type window regulator of claim 7, wherein the predetermined shape is the shape of a surface of the stopping portion that is orthogonal to an axial line of the pin member, and is a hexagonal shape.

9. The wire type window regulator of claim 6, wherein the first regulating portion prevents separation of the pulley support and the pin member.

10. The wire type window regulator of claim 9, wherein the first regulating portion includes a stopping portion having a predetermined shape and being disposed on the pin member, and a fitting hole that is provided in the pulley support and into which the stopping portion fits, and wherein the stopping portion and the fitting hole fit together so as to be substantially immobile relative to one another.

11. The wire type window regulator of claim 10, wherein the predetermined shape is the shape of a surface of the stopping portion that is orthogonal to an axial line of the pin member, and is a hexagonal shape.

* * * * *